US006805601B2

(12) United States Patent
Aoki et al.

(10) Patent No.: US 6,805,601 B2
(45) Date of Patent: Oct. 19, 2004

(54) METHOD FOR PRODUCING PLASMA DISPLAY PANEL AND THE PLASMA DISPLAY PANEL

(75) Inventors: Masaki Aoki, Osaka (JP); Mitsuhiro Ohtani, Osaka (JP); Junichi Hibino, Osaka (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 5 days.

(21) Appl. No.: 10/203,739

(22) PCT Filed: Feb. 21, 2001

(86) PCT No.: PCT/JP01/01250

§ 371 (c)(1),
(2), (4) Date: Aug. 13, 2002

(87) PCT Pub. No.: WO01/63640

PCT Pub. Date: Aug. 30, 2001

(65) Prior Publication Data

US 2003/0030376 A1 Feb. 13, 2003

(30) Foreign Application Priority Data

Feb. 22, 2000 (JP) ..... 2000-043907

(51) Int. Cl.[7] ..... H01J 9/24; B05D 3/04

(52) U.S. Cl. ..... 445/24; 445/35; 313/587; 427/304

(58) Field of Search ..... 445/24–25, 35; 313/582, 587; 427/304, 98, 305, 553; 430/315

(56) References Cited

U.S. PATENT DOCUMENTS 3,801,368 A * 4/1974 Fusayama et al. ..... 427/131
4,666,078 A * 5/1987 Ohno ..... 228/124.1
4,865,873 A * 9/1989 Cole et al. ..... 427/555
5,660,883 A * 8/1997 Omura ..... 427/304
5,863,679 A * 1/1999 Tsushima et al. ..... 430/14
5,874,125 A * 2/1999 Kanoh et al. ..... 427/98
6,110,597 A * 8/2000 Fujisawa et al. ..... 428/432
6,576,302 B1 * 6/2003 Mizuta et al. ..... 427/597
6,627,544 B2 * 9/2003 Izumi et al. ..... 438/678

FOREIGN PATENT DOCUMENTS

JP 06-280031 10/1994
JP 08-144061 6/1996
JP 09-113885 5/1997
JP 10-147769 6/1998
JP 10-226535 8/1998
JP 11-317161 11/1999
JP 2000147762 A * 5/2000 ..... G03F/07/029

* cited by examiner

*Primary Examiner*—Ashok Patel
*Assistant Examiner*—German Colón

(57) ABSTRACT

A method for producing a high-luminance and high-image-quality plasma display panel (PDP) reduced in panel yellowing, and the PDP obtained by the method. The method for forming electrodes in the PDP includes a base layer formation step for forming a base layer containing metal oxides on a glass substrate, a precipitation promoting step for depositing palladium on regions of the base layer where a metal layer will be formed, and a step for forming the metal layer on the regions. The metal oxides contained in the base layer is preferably made of one or more metal oxides selected out of nickel oxide, cobalt oxide, iron oxide, zinc oxide, indium oxide, copper oxide, titanium oxide, praseodymium oxide, and silicon oxide.

11 Claims, 11 Drawing Sheets

(a)

(b)

(c)

METHOD FOR PRODUCING PLASMA DISPLAY PANEL AND THE PLASMA DISPLAY PANEL

"This application is a 371 application of PCT/JP01/01250, filed Feb. 21, 2001".

TECHNICAL FIELD

The present invention relates to a method for manufacturing a plasma display panel and the plasma display panel.

BACKGROUND ART

Plasma display panels (hereafter abbreviated as PDPs) can be roughly divided into direct current (DC) types and alternating current (AC) types. At present, AC types, which are suited to upsizing of the panel, are prevalent.

The AC type PDP is composed of a front glass substrate and a back glass substrate which are disposed to face each other with partition walls in between. On the facing surface of the front glass substrate, a plurality of parallel display electrodes are provided, while on the facing surface of the back glass substrate, a plurality of address electrodes are provided orthogonal to the display electrodes. Red, green, or blue phosphors are each laid down in a discharge space formed by dividing the gap between both substrates by the partition walls and each space is filled with a discharge gas so as to form each colored light emitting cell.

In the PDP having the above-described structure, electric discharge is induced in each cell by applying a voltage to the corresponding electrode via the driving circuit, so that ultraviolet light is emitted. Then, phosphor particles included in the phosphors (red, green, and blue) are excited by the ultraviolet light to emit light.

The display electrode is composed of a metal layer such as Ag, or composed of lamination of a metal layer 522 such as Ag, Cu, or Cr formed on an ITO (Indium Tin Oxide) layer 521 as shown in FIG. 10. Such construction is generally formed by the methods shown in FIGS. 11A and 11B.

According to the method shown in FIG. 11A, an Ag electrode is formed by the photolithography method. In this method, the Ag electrode is formed by applying a photosensitive Ag paste on the glass substrate, exposing the photosensitive Ag paste to light through a mask, developing and baking it.

According to the method shown in FIG. 11B, lamination of Cr/Cu/Cr layers disposed on an ITO layer which makes up an electrode is formed by the photolithography method. In this method, the electrode is formed by depositing the ITO layer and the lamination of Cr/Cu/Cr by sputtering in this order and etching these layers.

However, the electrode made of Ag would cause a problem of yellowing in the glass substrate, and the electrode made of Cr/Cu/Cr would cause a problem of making the glass substrate blue because of Cu contained therein. Especially, the yellowing due to Ag would lead to degradation in color purity of emitted light. This problem occurs as follows. That is, Ag (specifically, Ag ions) in the electrode diffuses into the glass substrate and the dielectric layer during the baking steps of the electrode and the dielectric layer, and the diffused Ag ions are reduced by Sn, Na, and Pb ions contained in the glass substrate, so that Ag colloidal particles are precipitated.

In addition, the baking step of the electrode would lead to shrinkage of the electrode, which generates residual stresses in the finished electrode and so the electrode or the substrate itself would become deformed. Such deformation might result in reduction in the yields of the panels and increase in the cost of manufacturing the panels. Especially, this problem becomes remarkably serious for forming thick film electrodes with high definition patterns which are recently required for high-definition TVs.

Meanwhile, according to the method shown in FIG. 11B, it takes a long time to form a thick metal layer.

To cope with the above-mentioned problems, the Japanese Patent Publication No.3107018 discloses that an metal electrode is formed on the surface of the base layer disposed on the substrate by electroplating. According to this method, in order to give the plating only to the area where the metal electrode will be formed, a resist mask is formed on the other area by photolithography. Since such a method dispenses with the baking step of the electrode and so there is no problem of yellowing, the method is favorable for increasing the yields. However, the base layer has to have electrical conductivity, which causes a problem that materials available as the base layer are limited. Additionally, this method requires a step for forming the resist mask on the area where the electrode will not be formed, which makes the method more complicated.

DISCLOSURE OF THE INVENTION

In view of the above-described problems, the object of the invention is to provide a method for manufacturing a high-luminance and high-image-quality plasma display panel reduced in yellowing, and a plasma display panel obtained by the method.

In order to achieve the above object, a method for manufacturing a plasma display panel according to the invention includes a first electrode formation step for forming a plurality of first electrodes on a surface of a first substrate, a second electrode formation step for forming a plurality of second electrodes on a surface of a second substrate, and a substrate alignment step for aligning the first and the second substrates so as to face each other. Here, at least one of the first electrode formation step and the second electrode formation step includes the following substeps: a base layer formation substep for forming a base layer on the surface of the substrate; a precipitation promoting substep for conducting a procedure for promoting a precipitation reaction of a metal material at a region in the base layer where a metal layer will be formed; and a metal layer formation substep for forming the metal layer at the region by an electroless plating method, during or after the procedure in the precipitation promoting step.

Note here that, although the base layer may be conductors or insulators, the base layer using a conductor has to be accompanied with patterning of the layer.

With this method, since the metal layer is formed using the electroless plating method, it becomes easy to form an electrode with a thick film. Additionally, since there is no need to bake the electrode in the formation step thereof, thus formed electrode is not subject to residual stresses, while yellowing in the panel can be prevented.

In addition, the metal layer is formed following the procedure for promoting the precipitation reaction of the metal material. Therefore, thus formed metal layer is dense and has strong adhesion to the base layer. Note here that the precipitation promoting procedure may be conducted before the metal formation step, or in parallel with the metal formation step.

With this method, the metal layer can be selectively formed only on the required regions without using a resist mask.

Further, the laminated construction in which the base layer containing the metal oxide and the metal layer such as Ag are laminated on the substrate in this order can prevent yellowing in the panel. This is because the base layer prevents diffusion of metal ions from the metal layer into the substrate.

With reference to the procedure for promoting the precipitation reaction of the metal material, a catalyst for promoting the reaction is preferably deposited on the regions.

The catalyst is preferably palladium.

The catalyst can be deposited on the regions by immersing the substrate with the base layer thereon in an acid aqueous solution containing palladium and radiating light to the regions through the aqueous solution.

The acid aqueous solution containing palladium is preferably a palladium nitrate aqueous solution or a palladium acetate aqueous solution. This is because these solution can realize higher deposit density of palladium as compared with a palladium hydrochloride aqueous solution.

With this method, the patterning of the base layer can be made by selectively removing the portions of the base layer to which light is not radiated. That is, in the regions on which palladium is deposited, the palladium functions as a protective film so that the regions are not removed. Meanwhile, other regions on which the palladium is not deposited are removed.

Alternatively, palladium can be deposited on the regions by forming a resist film with a predetermined pattern on the base layer, depositing palladium on the base layer by sputtering, and then removing the resist film.

Next, the method for forming the metal layer on the regions without using a catalyst such as palladium will be described in the paragraphs that follow.

The precipitation promoting step and the metal formation step are concurrently performed. In these steps, the substrate on which the base layer is formed is immersed in an electroless plating solution, and light is radiated to the regions through a mask, so that the metal layer is formed on the regions.

This method makes use of a reduction precipitation reaction of the metal, which is caused by electrons excited by the radiated light through the medium of the electroless plating solution.

The base layer is preferably made of a metal oxide in terms of adhesion to the substrate and prevention against diffusion of metal ions into the substrate.

In the base layer formation step, a photosensitive film containing a metal or metal oxides is formed on the substrate, which is followed by development and etching processes, so that the base layer with a predetermined pattern can be formed on predetermined regions without using a resist film.

As for the photosensitive film, a gel film obtained by providing heat treatment for a sol film generated from a metal alkoxide substituted with a β-diketone chelate class or an organic polysilane film containing a metal oxide and a metal alkoxide can be used.

Since these films are clear and colorless, they are suitable for the base layer.

The base layer can be also formed by sputtering, a CVD method, dip-coating, a spray pyrolysis method, and the like.

The metal oxide is preferably made of one or more metal oxides selected out of nickel oxide, cobalt oxide, iron oxide, zinc oxide, indium oxide, copper oxide, titanium oxide, praseodymium oxide, and silicon oxide.

The method for manufacturing the PDP according to another embodiment of the invention includes a first electrode formation step for forming a plurality of first electrodes on a surface of a first substrate, a second electrode formation step for forming a plurality of second electrodes on a surface of a second substrate, and a substrate alignment step for aligning the first and the second substrates so as to face each other. Here, at least one of the first electrode formation step and the second electrode formation step includes the following substeps of: a base layer formation substep for forming a base layer at a region on the surface of the substrate where a metal layer will be formed, the base layer having higher precipitation reactivity of the metal than the surface of the substrate; and a metal layer formation substep for forming the metal layer on the base layer by an electroless plating method.

With this method, the metal layer is formed principally all over the base layer. Thus formed base layer can prevent yellowing in the panel in the same way as in the above-described method. Also, the metal layer is dense and has strong adhesion to the base layer.

Note here that the base layer can be formed, as previously mentioned, by patterning the metal oxide layer and depositing palladium all over the surface of the base layer. However, this method is preferable to such a method using palladium, because ZnO can function as the substitution for palladium. This is because the surface of the layer made of ZnO presents favorable precipitation reactivity of the metal material during the electroless plating.

More specifically, the ZnO layer is preferably made by forming a ZnO film all over the surface of the substrate using a thermal CVD method or a plasma CVD method, forming a resist film on regions of the ZnO film where the metal layer will be formed, which is followed by an etching process, and then removing the resist film.

When the thermal CVD method or the plasma CVD method is used for forming the ZnO film, thus obtained ZnO film has stronger adhesion to the substrate as compared with the film using the spray pyrolysis method and the like.

The above-mentioned methods are suitable for manufacturing PDPs whose first electrodes each consist of a plurality of line portions.

Further, a PDP according to the invention includes a first substrate on which a plurality of first electrodes are formed, a second substrate on which a plurality of second electrodes are formed, where the first and the second electrodes face each other. In the PDP, at least the first electrodes or the second electrodes have a construction in which a metal layer is laminated on a layer containing a metal oxide, and palladium is deposited at the interface between the layer containing the metal oxide and the metal layer.

The PDP having the above construction has electrodes being dense and having strong adhesion to the substrate, and is reduced in panel yellowing.

The metal oxide used for the PDP is preferably made of one or more metal oxides selected out of nickel oxide, cobalt oxide, iron oxide, zinc oxide, indium oxide, copper oxide, titanium oxide, praseodymium oxide, and silicon oxide.

BEST MODE FOR CARRYING OUT THE INVENTION

Figure 1:
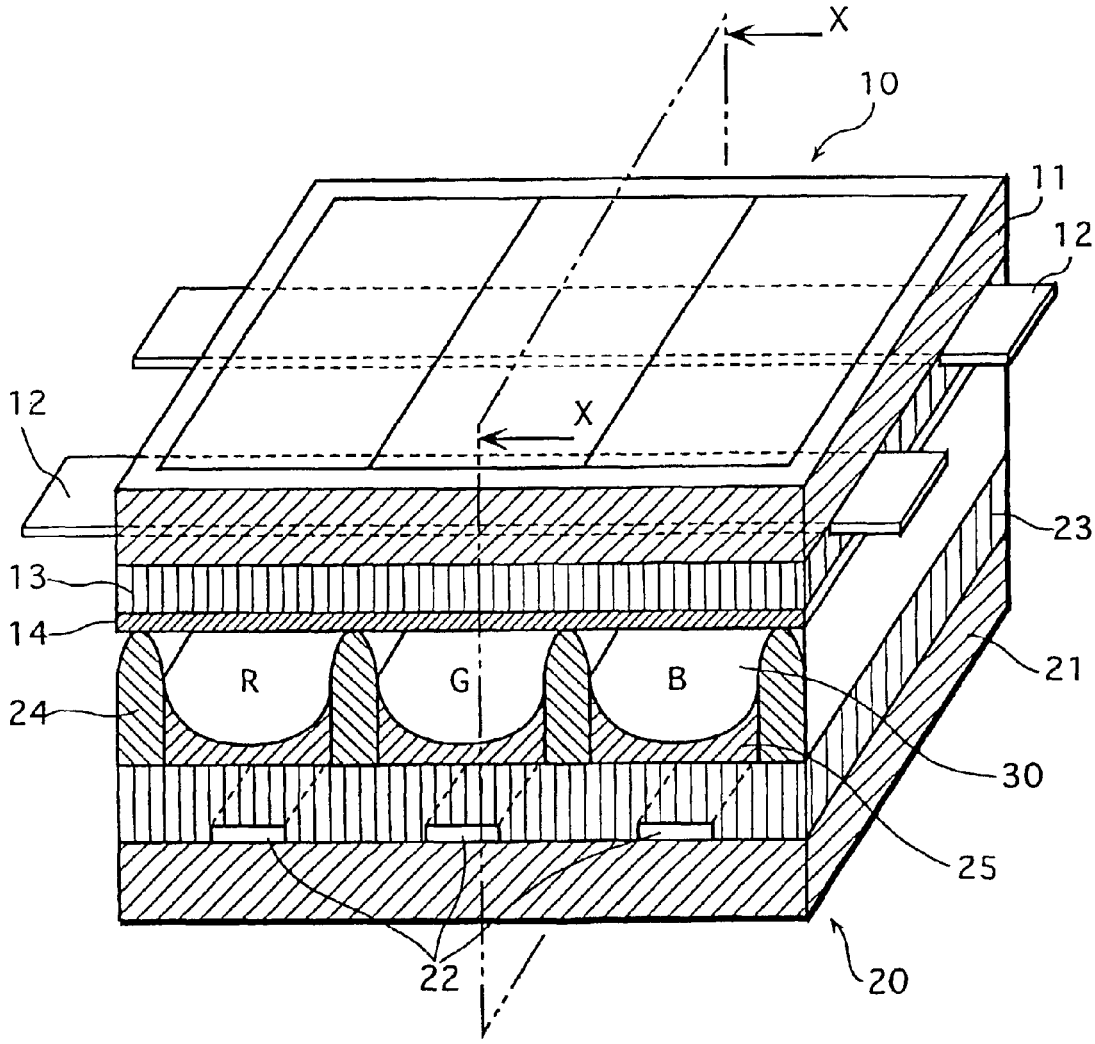
FIG. 1 is a perspective view of the main part of the PDP according to one embodiment of the invention.

FIG. 1 is a perspective view of the main part of the AC type PDP according to one embodiment of the invention, which shows a portion of the display area.

This PDP is constructed so that a front panel 10 and a back panel 20 are opposed to each other at a fixed interval in between.

The front panel 10 is made up of display electrodes 12 as first electrodes, a transparent dielectric layer 13, and a protective layer 14 formed in this order on a surface (the undersurface in FIG. 1) of the front glass substrate 11. The back panel 20 is made up of address electrodes 22 as second electrodes, a white dielectric layer 23, and partition walls 24 formed in this order on a surface (the top surface in FIG. 1) of the back glass substrate 21. Phosphor layers 25 are provided along the walls of the grooves made up of the partition walls 24 and the white dielectric layer 23. The phosphor layers 25 are repeatedly arranged in the order of red, green, and blue.

Glass plates made by the floating method are used for the front glass substrate 11 and the back glass substrate 21.

The gap between the front panel 10 and the back panel 20 is divided by the plurality of parallel partition walls 24 so that a plurality of discharge spaces 30 are formed. Each of the discharge spaces 30 are filled with a discharge gas.

Figure 2:
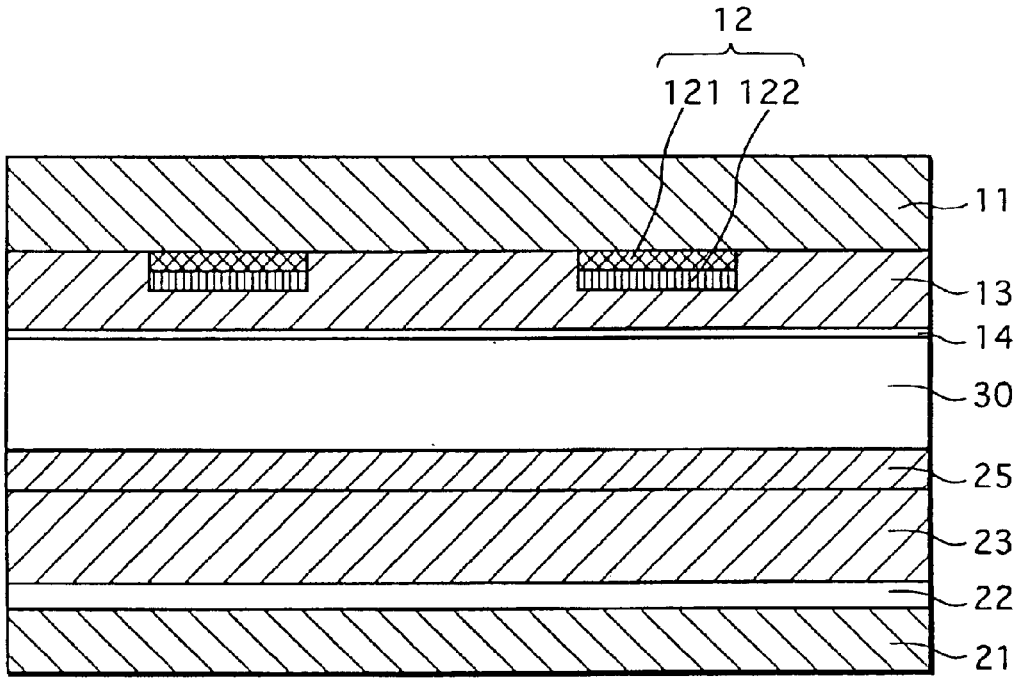
FIG. 2 is a view in the direction of the arrow X—X in FIG. 1.

FIG. 2 is a view in the direction of the arrow X—X in FIG. 1. As shown in FIG. 2, the display electrode 12 has a double-layered structure consisting of a metal oxide layer 121 and a metal layer 122.

Following describes the method for manufacturing the PDP with above-mentioned structure.

Method for Manufacturing the Front Panel 10

First, the display electrodes 12 are formed on a surface of the front glass substrate 11. The method for forming the display electrode 12 will be described later in the section "Method for Forming the Display Electrodes 12".

Then, a paste including glass powder (e.g., trade name of PLS-3244 PbO—$B_2O_3$—$SiO_3$—CaO series glass made by Nippon Electric Glass Co., Ltd.), which is grounded up into the average particle size of 1.5 $\mu$m by a jet mill, is applied over the display electrodes 12 using the die-coating method or the screen printing method, and baked to form the dielectric layer 13. The paste used here is a mixture of a binder consisting of terpineol, butyl carbitol acetate, or pentanediol containing ethyl cellulose of 5 to 15 wt % with the glass powder of 35 to 70 wt %. When mixing the paste, a nonionic surface-active agent of approximately 0.1 to 3.0 wt % may be added in order to improve diffusion of the glass powder and prevent precipitation of the same.

Then, after drying the glass substrate 11, the glass substrate 11 is baked at a temperature a little higher than the softening point of the glass (i.e., 550 to 590° C.)

Finally, the protective layer 14 made of MgO is formed on the surface of thus formed dielectric layer 13 by sputtering, for example.

In this way, the front panel 10 is prepared.

Method for Manufacturing the Back Panel 20

A paste for the Ag electrode is screen-printed on the back glass substrate 21 and baked to form the address electrodes 22. On the address electrodes 22, a paste containing titanium oxide ($TiO_2$) particles and dielectric glass particles is applied by the screen printing method and baked to form the white dielectric layer 23. Then, a glass paste for partition walls is applied by the screen printing method and baked to form the partition walls 24. Alternatively, the partition walls 24 can be formed by sandblasting.

Then, phosphor pastes of red, green, and blue are each applied to the walls of the grooves made up of the partition walls 24 and the white dielectric layer 23 by the screen printing method, and baked in the air (e.g., for 10 minutes at 500° C.) to form each colored phosphor layers 25.

In this way, the back panel 20 is prepared.

Alternatively, the phosphor layers 25 may be formed as follows. First, sheet-type photosensitive resin containing each colored phosphor material is prepared. Then, the sheet-type resin is attached to a surface of the back glass substrate 21 to which the partition walls 24 are provided, a pattern is created therein by the photolithography method, and unnecessary portions are removed by development to complete the phosphor layers 25.

Sealing of the Front Panel 10 and the Back Panel 20

Sealing glass (glass flit) is applied on either the front panel 10 or the back panel 20 or on both of them, and pre-baked to form a sealing glass layer. Then, the front panel 10 and the back panel 20 are aligned so that the display electrodes 12 and the address electrodes 22 are orthogonally faced, and heated so as to soften the sealing glass layer to seal both of the panels.

Finally, thus formed discharge spaces 30 are exhausted to a high vacuum ($1.1\times10^{-4}$ Pa) and filled with the discharge gas at a predetermined pressure to complete the PDP.

Following describes the method for forming the display electrodes 12, which are the most distinctive elements in embodiments according to the invention.

Method for Forming the Display Electrodes 12

First Embodiment

Figure 10:
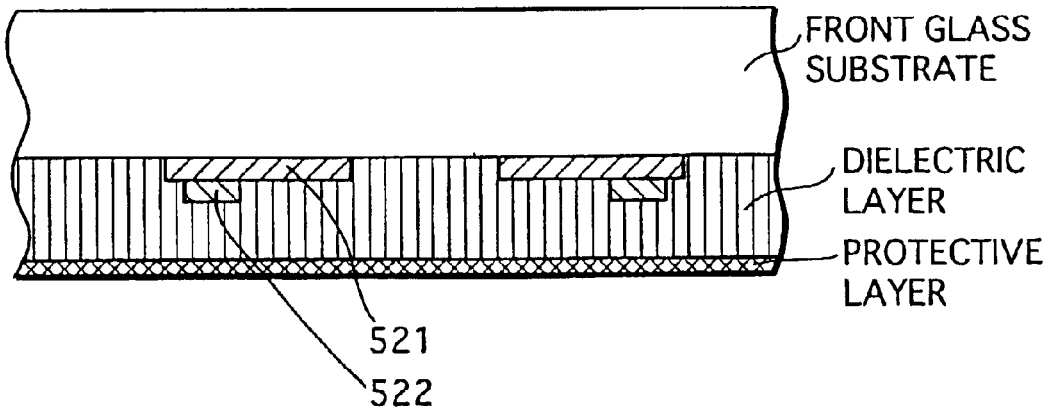
FIG. 10 is a sectional view of conventional front panel.

The process for forming the display electrodes 12 can be roughly divided into the step for forming the base layer 121 containing metal oxides and the step for forming the metal layer 122. This first embodiment further includes a process for promoting the precipitation reaction of a metal on a predetermined regions of the base layer 121 where the metal layer will be formed prior to the step for forming the metal layer 122. Note here that the predetermined regions may be all of the patterned base layer 121 as shown in FIG. 2, or a portion of the layer 121 (i.e., narrower area than the layer 121 containing metal oxide). The latter case applies to a metal layer 522 of narrow width being laminated on an ITO layer 521 of broader width as shown in FIG. 10.

Firstly, the method for manufacturing the base layer 121 on the glass substrate 11 is described in the paragraphs that follow.

(1) Method for Forming the Base Layer 121

The materials for the base layer 121 may be conductors or insulators insofar as they possess excellent adhesion to the glass substrate 11 and can prevent the diffusion of metal ions into the glass substrate 11. However, the case using a conductor has to be accompanied with patterning of the layer. Additionally, there is no limitation on the material used for the base layer 121 insofar as they are transparent so as not to substantially block the light when the panel emits the light and thin with a thickness of approximately 0.1 $\mu$m. More specifically, one or more types of materials selected out of nickel oxide, cobalt oxide, iron oxide, zinc oxide, indium oxide, copper oxide, titanium oxide, praseodymium oxide, and silicon oxide can be used.

The following sections (1-1) to (1-5) describe concrete examples of the method for forming the base layer 121.

(1-1) Sputtering

Figure 7:
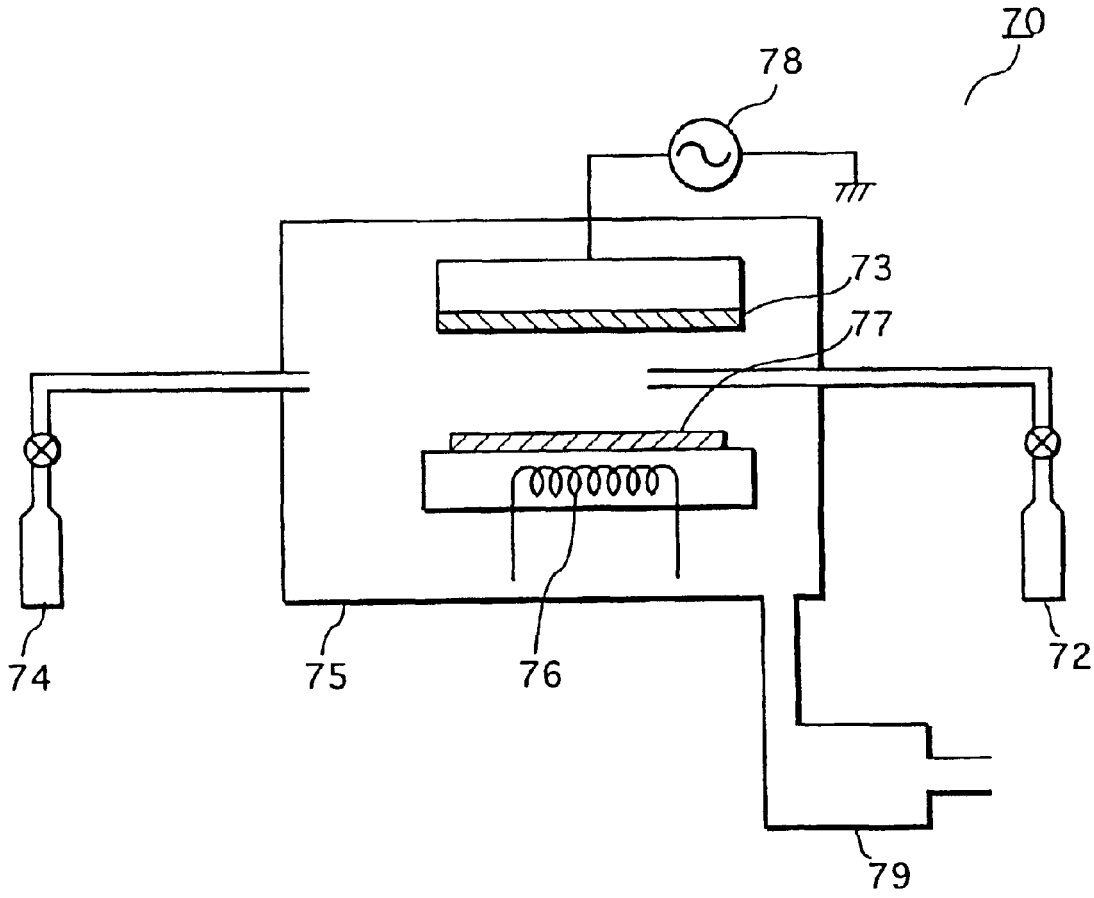
FIG. 7 is a schematic diagram of the sputtering apparatus used for forming the electrodes in the PDP according to one embodiment of the invention.

FIG. 7 is a schematic diagram of the sputtering apparatus.

As shown in FIG. 7, the sputtering apparatus 70 is made up of a radio-frequency (RF) power supply 78 which generates plasma, a heater unit 76 which heats the glass substrate 77, an exhausting device 79 which reduces the pressure within the apparatus, an Ar gas cylinder 74, and an oxygen cylinder 72.

The RF power supply 78 is connected to a target 73 provided within the apparatus. The target 73 is made of an oxide as a source material of the metal oxide film (NiO, CoO, FeO, ZnO, $In_2O_3$, $TiO_2$, $Pr_6O_{11}$, and $SiO_2$) or a mixture of them.

Following describes the method for forming a metal oxide layer by means of the above-stated apparatus.

The glass substrate 77 is placed on the heater unit 76 and heated to the predetermined temperature (250° C.), while the internal pressure of the apparatus is reduced to $1.33\times10^{-1}$ Pa by means of the exhausting device 79. Next, Ar gas is introduced into the apparatus from the Ar gas cylinder 74, and RF electric field with 13.56 MHz is applied thereto by means of the RF power supply 78. Thus, the metal oxide layer is formed.

(1-2) CVD Method

Figure 8:
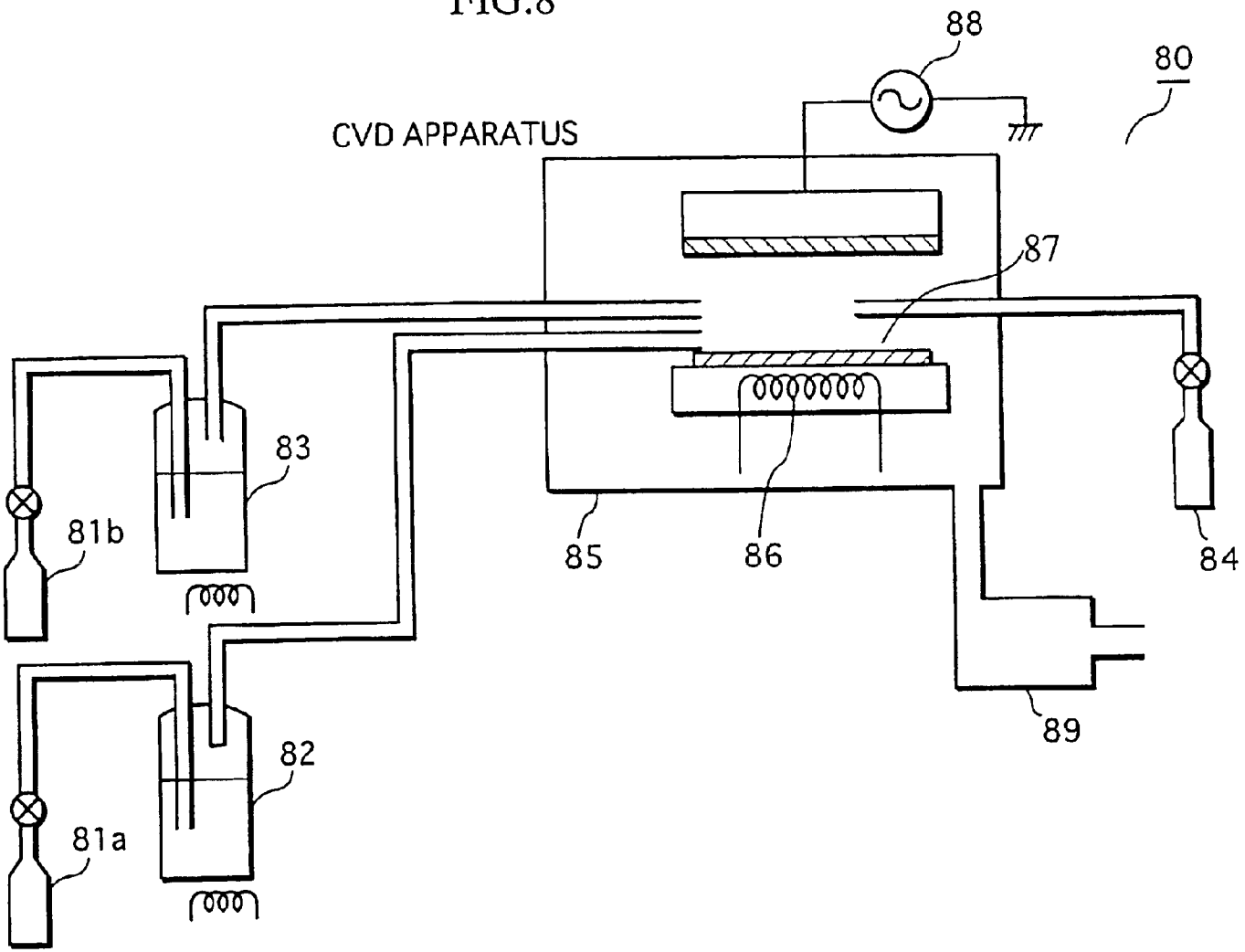
FIG. 8 is a schematic diagram of the CVD apparatus used for forming the electrodes in the PDP according to one embodiment of the invention.

FIG. 8 is a schematic diagram of the CVD apparatus.

As shown in FIG. 8, the CVD apparatus 80 is made up of a heater unit 86, an exhausting unit 89, an RF power supply 88, Ar gas cylinders 81*a* and 81*b*, bubblers 82 and 83, and an oxygen cylinder 84.

The Ar gas cylinders 81*a* and 81*b* are each connected to the main body of the apparatus 85 via the bubblers 82 and 83.

Following describes the method for forming a metal oxide layer by means of the above-stated apparatus.

The bubbler 82 stores heated metal chelate as a source material of the metal oxide within it. The bubbler 82 functions so as to vaporize the metal chelate by the Ar gas provided from the Ar gas cylinder 81*a* and transfer the vaporized metal chelate into the main body of the apparatus 85. The metal chelate includes acetylacetone nickel ($Ni(C_5H_7O_2)_2$) and nickel-dipivaloyl-methane ($Ni(C_{11}H_{19}O_2)_2$), for example. As for Co, Ti, Fe, Zn, Cu, Pr, and Si as well, corresponding metal chelate can be used.

First, the glass substrate 87 is placed on the heater unit 86 and heated to the predetermined temperature (250° C.), while the internal pressure of the apparatus is reduced to several kilo-pascals by means of the exhausting apparatus 89. In such a state, Ar gas is introduced into the main body of the apparatus 85 from the Ar gas cylinder 81a or 81b via the bubbler 82 or 83. At the same time, oxygen gas is also introduced into the main body of the apparatus 85 from the oxygen cylinder 84. Then, chemical reaction occurs between thus introduced metal chelate and oxygen, so that the metal oxide layer is formed on the glass substrate 87.

Although the thermal CVD process is adopted in the above-mentioned method, the plasma CVD process can be performed with the same apparatus. Especially, a zinc oxide film formed using acetylacetone zinc ($Zn(C_5H_7O_2)_2$) or zinc-dipivaloyl-methane ($Zn(C_{11}H_{19}O_2)_2$) using the plasma CVD method has stronger adhesion to the substrate as compared with the films formed using the above-stated sputtering, the dip coating method, and the spray pyrolysis method, which will be described later.

(1-3) Dip Coating Method

Figure 9:
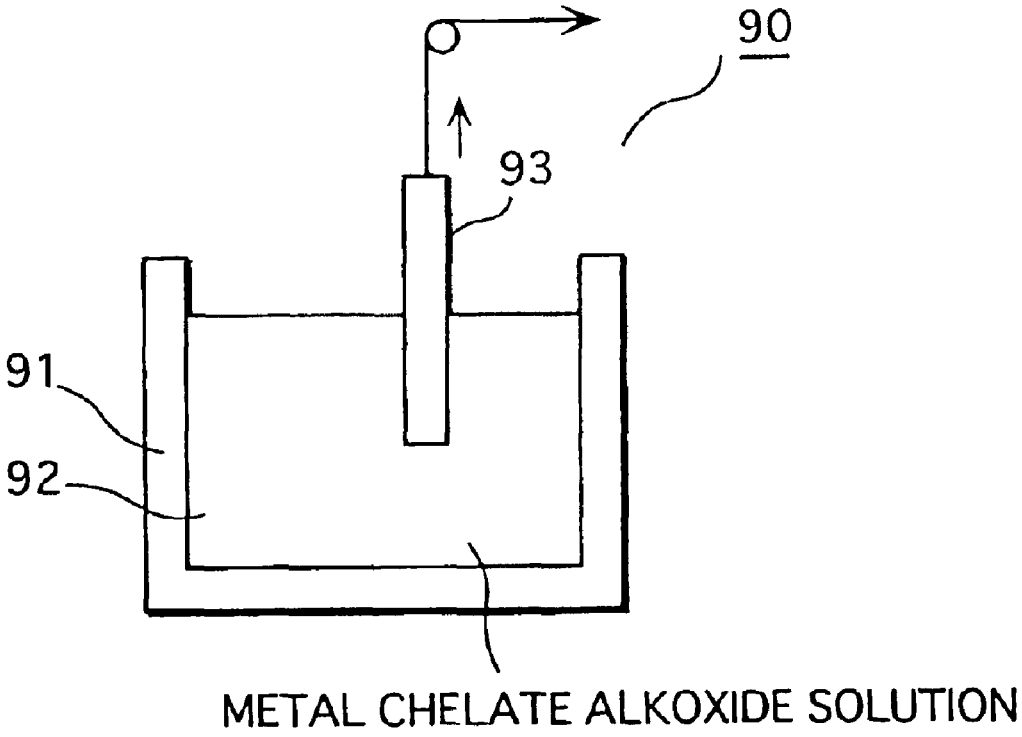
FIG. 9 is a schematic diagram of the dip-coating apparatus used for forming the electrodes in the PDP according to one embodiment of the invention.

FIG. 9 is a schematic diagram of the dip apparatus.

As shown in FIG. 9, the dip apparatus 90 stores solution 92 (dip solution) in which metal chelate such as acetylacetone and alkoxide is solved with organic solvent in the bath 91 of the apparatus. Acetylacetone metal chelate ($M((C_5H_7O_2)_2)$) or dipivaloyl-methane-metal chelate ($M((C_{11}H_{19}O_2)_2)$) can be used as the metal chelate. Here, M consists of one or more metals selected out of Ni, Co, Ti, Fe, Zn, Cu, Pr, and Si. Ethyl alcohol, butyl alcohol, and the like can be used as the organic solvent.

With this apparatus, the glass substrate 93 is dipped into the dip solution 92 and raised from there. Then, the glass substrate is dried and baked at a temperature between 400 to 600° C., so that the metal oxide layer is formed.

The pattern of the metal oxide film formed according to any one of the above methods (1-1) to (1-3) is created by etching. The etching process may be independently performed, or may double as the process for depositing palladium shown in FIG. 5B, which will be described later.

Next, the method for forming the base layer 121 having the required pattern without the etching process is described in the paragraphs that follow.

(1-4) Method Using Photosensitive Gel Film

A sol film made of metal alkoxide ($M(OR)_n$) (e.g., M; Zn, Al, Ti, Zr, In, etc., R; alkyl, and n; integer), which is substituted with β-diketone chelate class (e.g., acetylacetone or dipivaloyl-methane), is formed all over one surface of the glass substrate. By heat treatment for the sol film, a metal oxide gel film substituted with acetylacetone is formed. This gel film has a photosensitive property. Next, ultraviolet light with wavelength between 300 and 360 nm is radiated to the photosensitive gel film through a mask. After development process, an etching process is conducted to remove the portions to which the light is not radiated. Thus, the base layer 121 with the requested pattern can be formed. Concrete examples on this method will be described in the section (E).

(1-5) Method Using Photosensitive Organic Polysilane Film

First, solution, in which metal oxide particles with the average particle diameter of 0.2 $\mu$m (e.g., ZnO, $Al_2O_3$, $ZrO_2$, $TiO_2$, $In_2O_3$, $SnO_2$) or metal alkoxide ($M(OR)_n$) (e.g., M; Zn, Al, Zr, Ti, In Sn, R; alkyl, and n; integer) is dispersed in the organic polysilane, are applied all over one surface of the glass substrate. The organic polysilane has a photosensitive property. Then, ultraviolet light with wavelength of 250 to 350 nm is radiated to the regions on the surface of the glass substrate where electrodes will be formed through the mask, so that the organic polysilane film is formed. Next, etching is performed so that the portions of the organic polysilane film to which the ultraviolet light is not radiated are removed. After that, by applying heat treatment, the base layer 121 is formed on the regions. Concrete examples on this method will be described in the section (F).

The base layer 121 having the requested pattern can be formed on the glass substrate according to any one of the above methods (1-1) to (1-5).

Note here that the metal oxide film can be formed using the spray pyrolysis method as well. In this method, nitrate aqueous solution mixed with the metal oxide as material of the film is atomized with ultrasonic waves, which is sprayed on the heated glass substrate.

Following describes the method for forming the metal layer 122 on the predetermined regions in the base layer 121.

(2) Method for Forming the Metal Layer 122

The metal layer 122 can be made of Ag, Cu, Cr, Ni, etc., which has been conventionally used for electrodes in PDPs. Such a metal layer 122 is formed by conducting a procedure for promoting a precipitation reaction of the metal material on the predetermined regions in the base layer 121, which is followed by the electroless plating method. This method can be classified into the following two types according to difference in the method for promoting the precipitation reaction of the material on the predetermined regions in the base layer 121.

(2-1) Method Using Light

Figure 4:
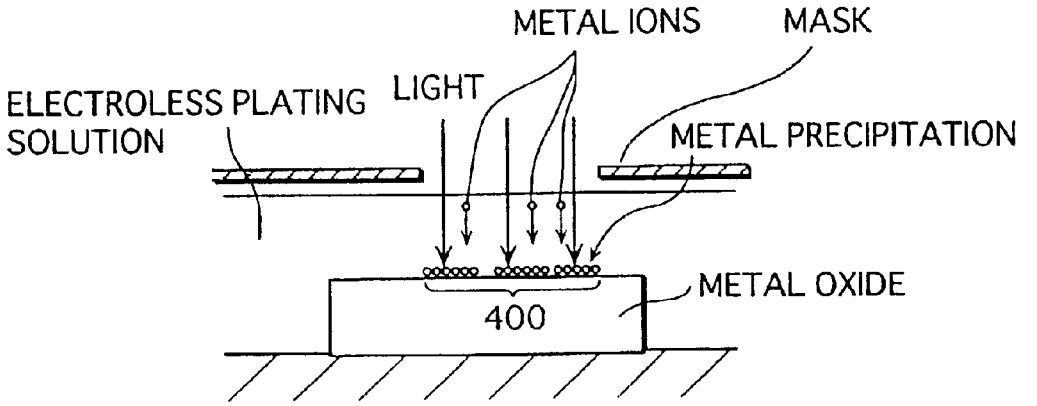
FIG. 4 shows the methods for forming the metal layer according to embodiments of the invention.
Figure 4:
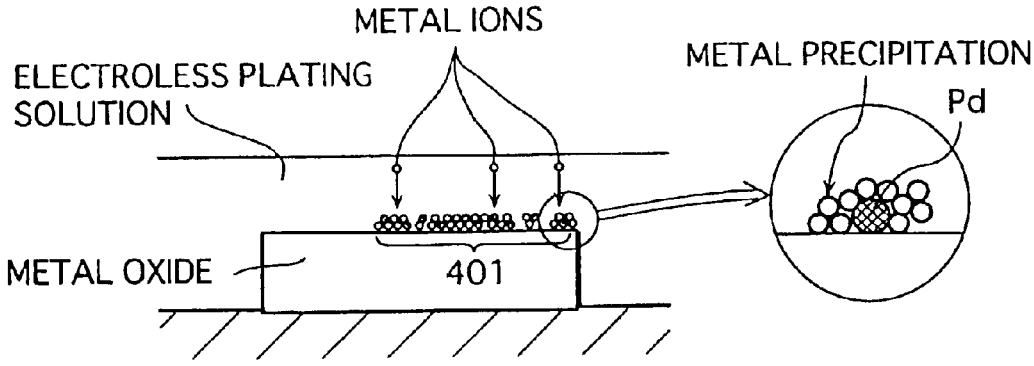
Figure 4:
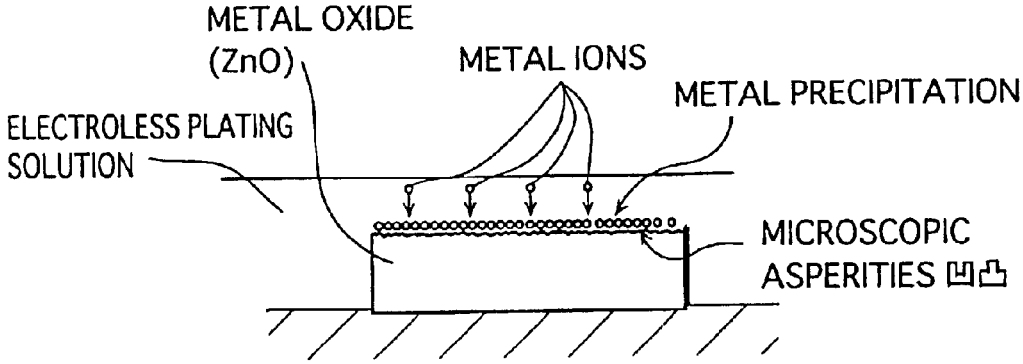

According to the method shown in FIG. 4A, the glass substrate on which the base layer is formed is immersed in the electroless plating solution containing reducing agent and complex formation agent including metal ions such as Ag, and light is radiated through the mask to the predetermined regions 400 in the base layer 121 on the glass substrate where the metal layers 122 will be formed. With this method, metal is selectively precipitated on the predetermined regions 400. This is because electrons excited by the light promote the reduction precipitation reaction of the metal on the regions 400.

(2-2) Method Using Palladium

According to this method, palladium is deposited on the predetermined regions in the base layer 121, and then, as shown in FIG. 4B, the glass substrate is immersed in the electroless plating solution to form the metal layers 122 in the predetermined regions 401. That is, the palladium adherent to the predetermined regions 401 functions as a catalyst in the electroless plating solution, so that the metal is selectively deposited on the predetermined regions 401 to form the metal layer 122 therein. Thus formed metal layer 122 is dense and strongly adheres to the base layer 121 because the palladium functions as an anchor.

With any one of the above methods (2-1) and (2-2), the metal layer 122 can be selectively formed on the predetermined regions in the base layer 121.

Second Embodiment

In the second embodiment, the base layer 121 which has higher precipitation reactivity of the metal material than the surface of the glass substrate is formed only in the regions where the metal electrodes will be formed. Then, the metal layer 122 is formed on the base layer 121 by the electroless plating method. Such a base layer 121 can be formed according to the above-described methods (2-1) and (2-2) which utilize light and palladium for promoting the precipitation reaction of the metal material. As another method, physical binding force of the surface of the base layer 121 can be utilized, which is described with reference to FIG. 4C.

(2-3) Method Using Physical Binding Force of the Surface of the Base Layer

Generally, the base layer 121 containing metal oxides has microscopic asperities on the surface. Therefore, the electroless plating after formation of the base layer 121 containing the metal oxide allows the metal layer 122 to be selectively formed on the base layer 121, because the microscopic asperities of the base layer 121 function as anchors to facilitate formation of the metal layer. This method makes use of the property that the surface of the base layer 121 has higher precipitation reactivity of the metal material than the surface of the glass substrate. Especially, in the case of the base layer 121 made of zinc oxide, this effect becomes remarkable, so that the metal layer 122 can be favorably formed selectively on the base layer 121. Details will be described in the section (D) "Electroless Plating Method without Palladium" (See FIG. 6D).

Such an effect as the anchor is more improved by treating the surface of the base layer 121 with chromic acid or the like.

The above method has an advantage that there is no need to use expensive palladium.

Concrete Examples of Method for Forming the Display Electrodes 12

Figure 5:
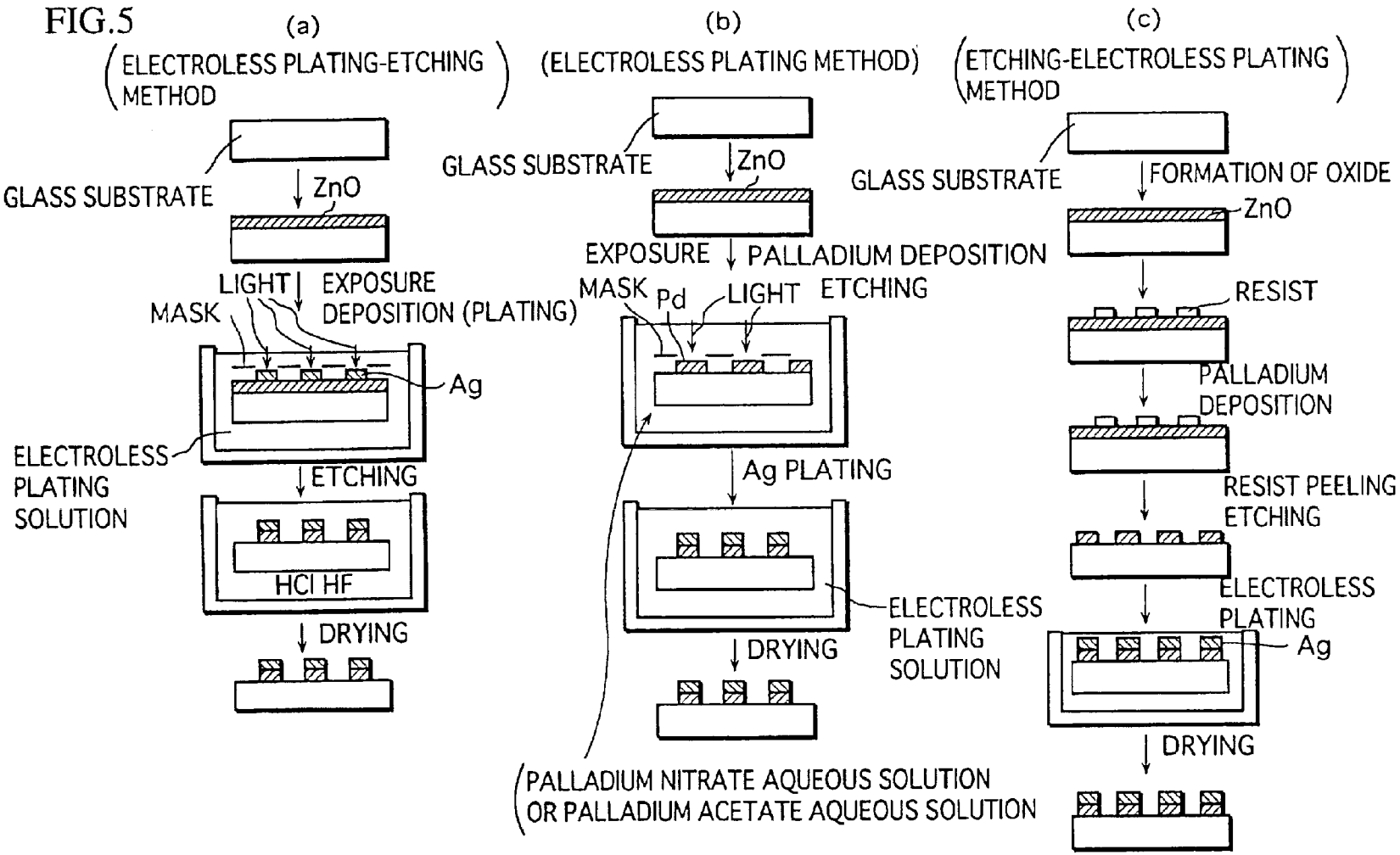
FIG. 5 shows the methods for forming electrodes in the PDP according to embodiments of the invention.
Figure 6:
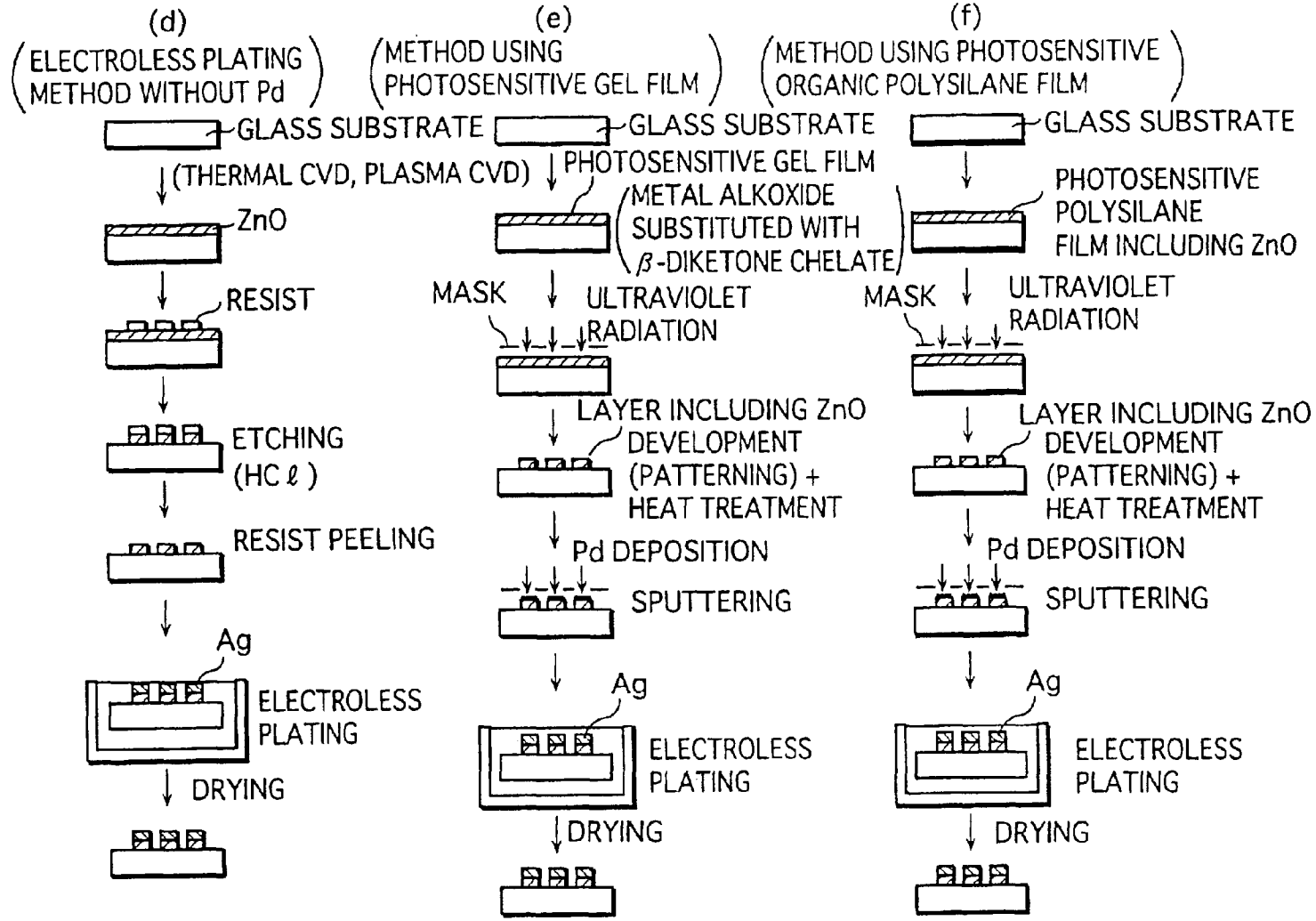
FIG. 6 shows the methods for forming electrodes in the PDP according to embodiments of the invention.

The following sections describe concrete examples of the method for forming the display electrodes 12, with reference to FIGS. 5 and 6.

Each of the processes A to F shown in FIGS. 5 and 6 is a combination of the above-described methods for forming the base layer 121 and forming the metal layer 122.

Following describes each of the processes A to F.

(A) Electroless Plating and Etching Method (See FIG. 5A)

First, a zinc oxide (ZnO) film with the thickness of 0.1 $\mu$m is formed all over one surface of the glass substrate. Then, an Ag layer is formed on the predetermined regions in the zinc oxide film according to the above method (2-1). Next, the substrate is immersed in an etchant (HCl or fluorinated acid). Since the Ag layer is resistant to the etchant, only portions of the ZnO layer on which the Ag layer is not formed are removed. After that, the glass substrate is dried, so that the display electrodes 12 composed of lamination of the Ag layer formed on the ZnO layer are completed.

(B) Electroless Plating Method (See FIG. 5B)

A ZnO film with the thickness of 0.1 $\mu$m is formed all over one surface of the glass substrate. This is formed in the same way as in the above (A). Then, this glass substrate is immersed in a palladium nitrate aqueous solution or a palladium acetate aqueous solution, and light is radiated to the predetermined regions of the ZnO film through the mask, so that palladium as the catalyst is deposited on the predetermined regions (i.e., regions where the metal layer will be formed) as described in the above section (2-2). In this process, the regions on which palladium is deposited are not etched because the palladium functions as a protective film, while other regions on which palladium is not deposited are etched with the palladium nitrate aqueous solution or the palladium acetate aqueous solution. Finally, electroless plating is conducted to such a glass substrate, so that the palladium as the catalyst selectively precipitates a metal material so as to form an Ag layer only on the ZnO layer.

Such deposition of palladium and etching of metal oxides may be conducted using a palladium hydrochloride aqueous solution as well. However, since the palladium nitrate aqueous solution or the palladium acetate aqueous solution can realize higher deposit density of palladium than the palladium hydrochloride aqueous solution, selectivity in the electroless plating can be improved, so that favorable electrodes can be formed.

(C) Etching and Electroless Plating Method (See FIG. 5C)

Resists are applied on the predetermined regions where electrodes will not be formed in the ZnO film with the thickness of 0.1 $\mu$m formed on the glass substrate. Here, the ZnO is formed in the same way as in the above (A). Then, palladium with the thickness of 0.01 to 1 μm is deposited on the glass substrate by sputtering. After removing the resists, etching is performed. In the etching process, portions of the ZnO film to which palladium adheres are not etched, but other portions of the ZnO film are removed. After that, the electroless plating is conducted, so that the Ag layer is formed only on the ZnO layer.

(D) Electroless Plating Method without Palladium (See FIG. 6D)

First, a ZnO film with the thickness of 0.1 μm is formed all over one surface of the glass substrate using the thermal CVD method or the plasma CVD method. Then, resists are applied on the predetermined regions in the ZnO film where electrodes will be formed. Next, etching is conducted to the glass substrate using hydrochloric acid (HCl) to form the ZnO layer in the predetermined regions. Then, after removing the resists, electroless plating is conducted so that an Ag layer is formed on the ZnO layer.

This embodiment applies to the method described in the above section (2-3).

In the above method, the reason for using the thermal CVD method and the plasma CVD method is that these methods give higher adhesion between the ZnO film and the glass substrate as compared with the case using the spray pyrolysis method and the like. Especially, the layer formed by the plasma CVD method using acetylacetone zinc ($Zn(C_5H_7O_2)_2$) or zinc-dipivaloyl-methane ($Zn(C_{11}H_{19}O_2)_2$) can give strong adhesion to the glass substrate.

(E) Method for Forming the Base Layer Using Photosensitive Gel Film (See FIG. 6E)

A ZnO film is formed all over one surface of the glass substrate according to the above-described method (1-4). Then, palladium is deposited on the predetermined regions, where electrodes will be formed, in the ZnO film through the mask by sputtering. After that, electroless plating is conducted, so that an Ag layer is selectively formed on the predetermined regions.

(F) Method for Forming the Base Layer Using Organic Polysilane Film (See FIG. 6F)

A ZnO film is formed all over one surface of the glass substrate according to the above-mentioned method (1-5). Palladium is deposited on the predetermined regions, where a metal layer will be formed, through the mask by sputtering. After that, electroless plating is conducted, so that an Ag layer is formed.

In this way, the ZnO layer 121 is formed on the predetermined regions in the glass substrate 11, and then the Ag layer 122 can be formed on the ZnO layer 121.

In the above methods (A) to (F), ZnO is used as the metal oxide. However, the metal oxide may be one or more metal oxides selected out of nickel oxide, cobalt oxide, iron oxide, zinc oxide, indium oxide, copper oxide, titanium oxide, praseodymium oxide, and silicon oxide. Alternatively, materials other than metal oxides may be used insofar as the materials have excellent adhesion to the glass substrate and can prevent diffusion of metal ions into the substrate. Further, although Ag is used for the metal layer 122, other materials such as Cu, Ni, and Cr may be used.

Effects

According to the above-described methods for forming the electrodes, the base layer 121 made of such as ZnO having excellent adhesion to the glass substrate is formed between the metal layer such as Ag and the glass substrate 11. As a result, binding between the display electrodes 12 and the glass substrate 11 becomes tight, and yellowing due to Ag or coloring due to Cu, Ni, and Cr of the glass substrate 11 can be prevented. This is because the base layer 121 prevents diffusion of metal ions into the glass substrate 11 and the above methods for forming electrodes does not include baking processes.

In addition, the method for forming thin films such as sputtering takes a long time period to form electrodes with thick films. However, the above-described methods which use electroless plating method for forming the metal layer 122 can easily form electrodes with thick films and a fine pattern.

Further, formation of the base layer 121 using the dip coating method and the spray pyrolysis method eliminates the need for vacuum devices in the processes for forming the base layer 121 and the metal layer 122, which has an advantage of reduction in equipment costs.

Figure 3:
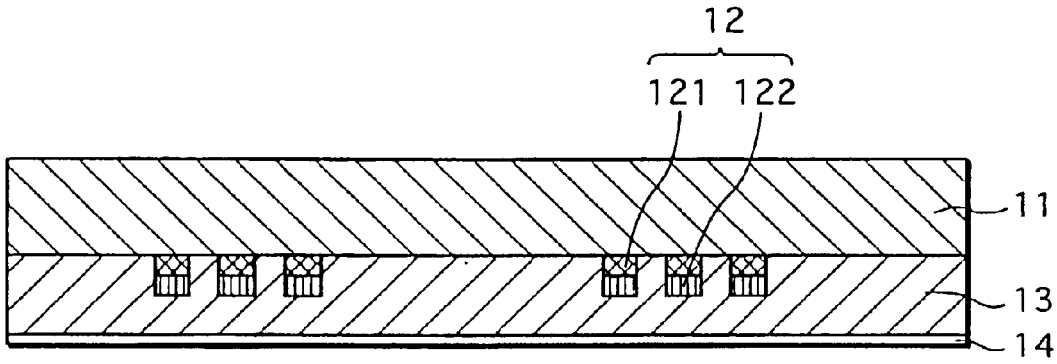
FIG. 3 is a sectional view of the front panel equipped with fence electrodes.

Moreover, the methods according to the invention are effective for forming so-called fence electrodes as shown in FIG. 3. The fence electrodes are now in the research and development stage and each electrode consists of a plurality of line portions. The fence electrodes have a high definition pattern in which each line portion is thin in width but relatively thick in thickness. Therefore, in the case where formation of the metal electrodes is followed by a baking process, it is difficult to accurately form the electrodes. On the other hand, according to the electroless plating method which eliminates the need for the baking process, the electrodes can be accurately formed and thick films can be easily formed.

The effects of the embodiments according to the invention was verified by the following examples.

EXAMPLES

Data on PDPs as the examples according to the invention and PDPs for comparison are listed in the Tables 1 and 2.

In these Tables 1 and 2, the display electrodes in the PDPs with sample Nos. 1 to 15, and 17 to 34 are formed according to the above-described embodiments. While, the Ag electrode of the PDP with sample No. 16 is formed on the glass substrate by the photolithography method for comparison.

TABLE 1

| Sample No. | 1st,2nd electrodes base layer | 1st,2nd electrodes metal layer | Method for forming base layer | Method for precipitating metal | Method for depositing Pd | Method for forming metal layer | Measurement result of color difference value a | Measurement result of color difference value b | Color temperature of panel |
|---|---|---|---|---|---|---|---|---|---|
| 1 | NiO | Ag | Sputtering | Pd deposition | Sputtering | Method of FIG. 5C | −1.0 | +0.5 | 9,201 |
| 2 | ZnO | Ag | Sputtering | Pd deposition | Sputtering | Method of FIG. 5C | −2.0 | +1.5 | 9,060 |

TABLE 1-continued

Figure 11:
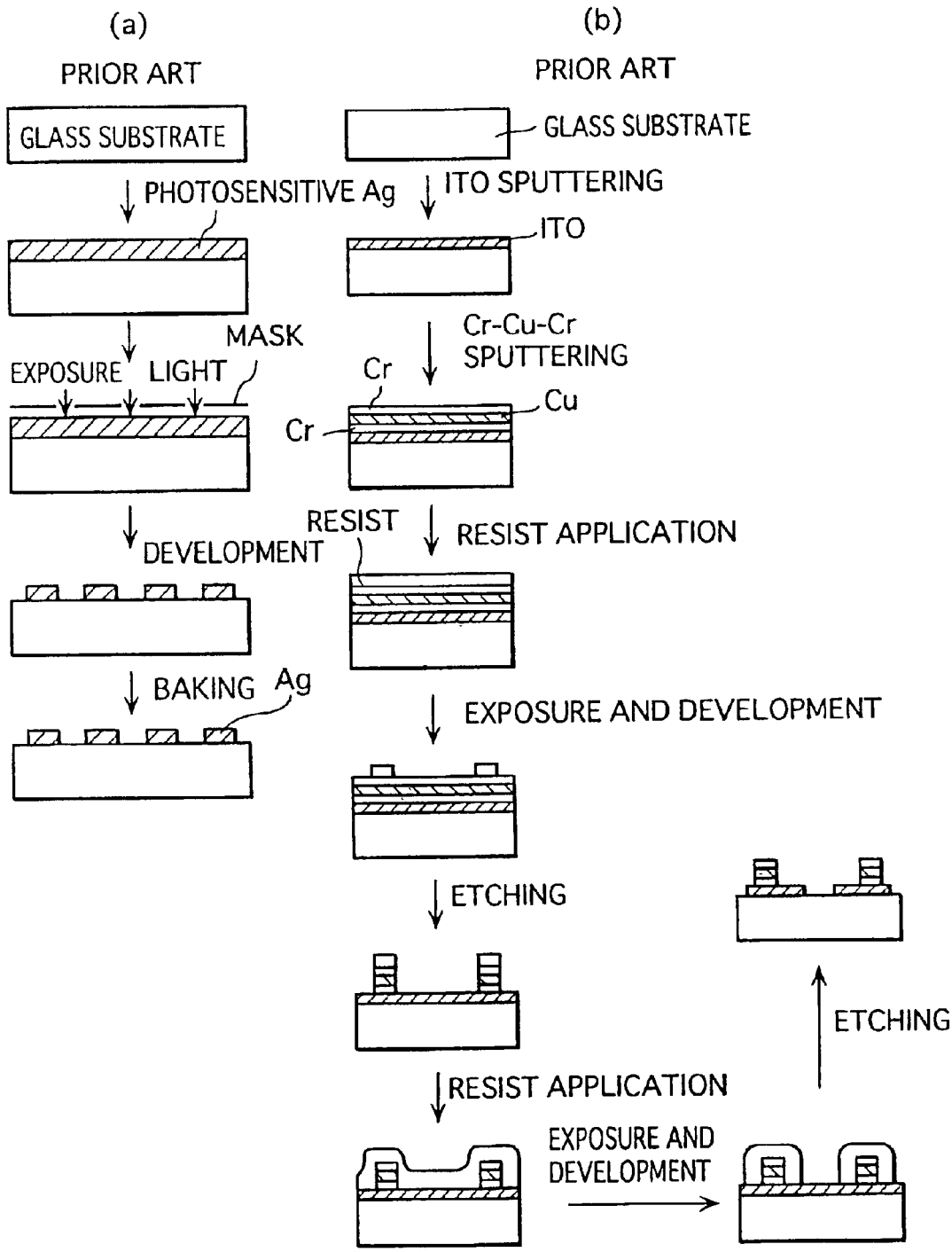
FIG. 11 shows the conventional method for forming electrodes in a PDP.

| Sample No. | 1st,2nd electrodes base layer | 1st,2nd electrodes metal layer | Method for forming base layer | Method for precipitating metal | Method for depositing Pd | Method for forming metal layer | Measurement result of color difference value a | Measurement result of color difference value b | Color temperature of panel |
|---|---|---|---|---|---|---|---|---|---|
| 3 | ZnO | Ag | Plasma CVD | Pd deposition | Method of (2-2) | Method of FIG. 5B | −2.2 | −0.6 | 9,280 |
| 4 | ZnO | Ag | Plasma CVD | Light(2-1) | — | Method of FIG. 5A | −1.5 | −0.4 | 9,330 |
| 5 | ZnO | Ag | Thermal CVD | Pd deposition | Method of (2-2) | Method of FIG. 5A | −2.0 | +0.6 | 9,110 |
| 6 | ZnO | Ag | Plasma CVD | None | — | Method of FIG. 6D | −2.8 | −0.5 | 9,240 |
| 7 | ZnO | Cu—Ni | Dip Coating | None | — | Method of FIG. 6D | −2.1 | −0.3 | 9,380 |
| 8 | $In_2O_3$ | Cu | Sputtering | Pd deposition | Method of (2-2) | Method of FIG. 5C | −2.9 | −0.5 | 9,260 |
| 9 | $Cu_2O$ | Cu | Sputtering | Pd deposition | Sputtering | Method of FIG. 5C | −2.3 | −0.4 | 9,265 |
| 10 | $TiO_2$ | Ni | Sputtering | Pd deposition | Sputtering | Method of FIG. 5C | −2.5 | −0.5 | 9,222 |
| 11 | $SiO_2$ | Ag | Sputtering | Pd deposition | Sputtering | Method of FIG. 5C | −1.8 | +2.0 | 8,890 |
| 12 | $Pr_6O_{11}$ | Cu | Sputtering | Light(2-1) | — | Method of FIG. 5A | −2.0 | −0.5 | 9,235 |
| 13 | $SiO_2$ | Ag—Ni | Sputtering | Pd deposition | Method of (2-2) | Method of FIG. 5C | −1.8 | +1.4 | 9,070 |
| 14 | $SiO_2$ | Ag—Cu | Sputtering | Pd deposition | Sputtering | Method of FIG. 5C | −2.1 | +1.6 | 8,950 |
| 15 | $SiO_2$ | Cr | Sputtering | Pd deposition | Sputtering | Method of FIG. 5C | −1.9 | −0.3 | 9,390 |
| 16 | None | Ag | None | None | None | Method of FIG. 11A | −2.0 | +16.3 | 6,450 |
| 17 | CoO | Ag | Thermal CVD | Pd deposition | Sputtering | Method of FIG. 6D | −3.0 | +1.5 | 9,000 |
| 18 | $PrO_3$ | Ag | Thermal CVD | Pd deposition | Sputtering | Method of FIG. 6D | −2.1 | −0.4 | 9,285 |
| 19 | $SiO_2$ | Ag | Plasma CVD | Pd deposition | Sputtering | Method of FIG. 6D | −2.0 | +2.0 | 8,890 |
| 20 | NiO | Ag | Dip Coating | Pd deposition | Sputtering | Method of FIG. 6D | −2.1 | +0.6 | 9,157 |
| 21 | $TiO_2$ | Ag | Dip Coating | Pd deposition | Sputtering | Method of FIG. 6D | −2.1 | +0.6 | 9,130 |
| 22 | $Fe_2O_3$ | Ag | Dip Coating | Pd deposition | Sputtering | Method of FIG. 6D | −1.0 | −0.5 | 9,310 |
| 23 | $SiO_2$ | Ag | Dip Coating | Pd deposition | Sputtering | Method of FIG. 6D | −2.0 | +2.0 | 8,915 |
| 24 | ZnO | Ag | Photosensitive gel | Pd deposition | Sputtering | Method of FIG. 6E | −2.1 | +0.6 | 9,115 |
| 25 | $Al_2O_3$ | Ag | Photosensitive gel | Pd deposition | Sputtering | Method of FIG. 6E | −1.9 | +0.8 | 9,084 |
| 26 | $TiO_2$ | Ag | Photosensitive gel | Pd deposition | Sputtering | Method of FIG. 6E | −2.1 | +0.7 | 9,025 |
| 27 | $ZrO_2$ | Ag | Photosensitive gel | Pd deposition | Sputtering | Method of FIG. 6E | −2.3 | +0.9 | 9,001 |
| 28 | $In_2O_3$ | Ag | Photosensitive gel | Pd deposition | Sputtering | Method of FIG. 6E | −2.0 | +1.0 | 8,995 |
| 29 | ZnO | Ag | Photosensitive organic polysilane | Pd deposition | Sputtering | Method of FIG. 6F | −2.1 | +0.5 | 9,250 |
| 30 | $Al_2O_3$ | Ag | Photosensitive organic polysilane | Pd deposition | Sputtering | Method of FIG. 6F | −2.0 | +0.7 | 9,090 |
| 31 | $ZrO_2$ | Ag | Photosensitive organic polysilane | Pd deposition | Sputtering | Method of FIG. 6F | −2.3 | +1.0 | 9,000 |
| 32 | $TiO_2$ | Ag | Photosensitive organic polysilane | Pd deposition | Sputtering | Method of FIG. 6F | −2.2 | +0.8 | 9,056 |
| 33 | $In_2O_3$ | Ag | Photosensitive organic polysilane | Pd deposition | Sputtering | Method of FIG. 6F | −2.1 | +1.1 | 8,965 |
| 34 | $SnO_2$ | Ag | Photosensitive organic polysilane | Pd deposition | Sputtering | Method of FIG. 6F | −2.3 | +0.3 | 9,250 |

The size of cells in the above PDPs is as follows. This size was selected corresponding to the 42" display for VGA.

Height of partition walls: 0.15 mm

Cell pitch: 0.36 mm

Distance between display electrodes: 0.10 mm

Discharge gas: Ne—Xe series mixed gas including Xe of 5 volume %

Charged pressure: 80 kPa (600 Torr)

$PbO—B_2O_3—SiO_2—CaO$ series glass was used for the dielectric gas in the front panel. The glass made by adding titanium oxide ($TiO_2$) to the glass having the same composition for the front panel was used for the white dielectric glass layer in the back panel.

Evaluation

With reference to the glass substrates including the dielectric glass layer of the PDP manufactured as above, values "a" and "b" (according to JIS Z8730, Methods for Specification of Color Differences), each of which indicate the degree of coloring, were measured with the color-difference meter (made by Nippon Densyoku, Product No. NF777). Note here that positively larger value of "a" indicates higher degree in red, while negatively larger value of "a" indicates higher degree in green. Similarly, positively larger value of "b" indicates higher degree in yellow, while negatively larger value of "b" indicates higher degree in blue. Particularly, if the value of "b" exceeds +10, then yellow becomes prominent. When the values of "a" and "b" are both within the range from −5 to +5, it can be considered that coloring of the panel is insignificant.

Also, the color temperature for the panels in the totally white mode was measured with the multichannel spectrophotometer (made by Otsuka Electronics Co., Ltd., MCPD-7000).

On the basis of these two kinds of measurement results, PDPs according to the embodiments and PDPs for comparison were evaluated. The measurement results are listed in Tables 1 and 2.

As indicated in Tables 1 and 2, the PDP for comparison (Sample No. 16) had the values a and b of −2.0 and +16.3, respectively. Since the value b exceeded +10, a tinge of yellow was prominent. On the other hand, the PDPs according to the embodiments (Sample Nos. 1 to 15, and 17 to 34) had the values a and b of −2.0 to +1.2 and −1.4 to +2.0, respectively. Therefore, coloring of these panels were not insignificant.

Additionally, since the value of b of the panel for comparison (Sample No. 16) was large of +16.3, the color temperature of the panel was 6,450K. Meanwhile, those of the panels according to the embodiments were higher of 8,890 to 9,390K.

From these results, the PDPs according to the embodiments were less in the degree of yellow and higher in the color temperature as compared with the PDP for comparison.

Note that, although the PDPs according to the embodiments use $PbO—B_2O_3—SiO_3—CaO$ series glass as the dielectric glass in the front panel, the same results were obtained by the PDPs using $Bi_2O_3$ series glass and ZnO series glass.

INDUSTRIAL APPLICABILITY

The method for manufacturing the PDP and the PDP according to the present invention are applicable to display devices such as computers and TVs, and effective for realizing large-sized high-definition and high luminance display devices.

What is claimed is:

1. A plasma display panel manufacturing method including a first electrode formation step for forming a plurality of first electrodes on a surface of a first glass substrate, a step for applying a dielectric material on the surface of the first glass substrate on which the plurality of first electrodes have been formed and baking the result, a second electrode formation step for forming a plurality of second electrodes on a surface of a second glass substrate, a step for applying a white dielectric material on the surface of the second glass substrate on which the plurality of second electrodes have been formed and baking the result, and a glass substrate alignment step for aligning the first and the second glass substrates so as to face each other, wherein at least one of the first electrode formation step and the second electrode formation step comprises the following substeps:

a base layer formation sub step for forming a base layer containing one or more metal oxides selected out of copper oxide, praseodymium oxide, cobalt oxide, nickel oxide, iron oxide, aluminum oxide, and zirconium oxide on the surface of the glass substrate;

a precipitation promoting substep for conducting a procedure for promoting a precipitation reaction of Ag at a region in the base layer where a layer containing Ag will be formed; and an Ag layer formation substep for forming the layer containing Ag at the region by an electroless plating method, during or after the procedure in the precipitation promoting step, wherein the base layer and the layer containing Ag make up the electrode.

2. The plasma display panel manufacturing method according to claim 1, wherein in the precipitation promoting substep, a catalyst for promoting the precipitation reaction of Ag is deposited on the region.

3. The plasma display panel manufacturing method according to claim 2, wherein the catalyst is palladium.

4. The plasma display panel manufacturing method according to claim 2, wherein in the precipitation promoting substep, the glass substrate on which the base layer is formed is immersed in an acid aqueous solution containing palladium and light is radiated to the region, so that the palladium is deposited on the region and portions of the base layer to which the light is not radiated are removed.

5. The plasma display panel manufacturing method according to claim 4, wherein the acid aqueous solution containing palladium is a palladium nitrate aqueous solution or a palladium acetate aqueous solution.

6. The plasma display panel manufacturing method according to claim 2, wherein in the precipitation promoting substep, a resist film with a predetermined pattern is formed on the base layer, palladium is deposited by sputtering in portions on the base layer on which the resist film is not formed, and then the resist film is removed.

7. The plasma display panel manufacturing method according to claim 1, wherein the precipitation promoting substep and the Ag layer formation substep are concurrently performed, and the glass substrate on which the base layer is formed is immersed in an electroless plating solution and light is radiated to the region through a mask, so that the layer containing Ag is formed at the region.

8. The plasma display panel manufacturing method according to claim 1, wherein in the base layer formation substep, a photosensitive film containing one or more materials selected out of aluminum, zirconium, indium, aluminum oxide, zirconium oxide, and indium oxide is formed on the glass substrate, and development and etching processes are performed, so that the base layer is formed at a predetermined region.

9. The plasma display panel manufacturing method according to claim 8, wherein the photosensitive film is an organic polysilane film containing a metal oxide or a metal alkoxide.

10. A plasma display panel manufacturing method including a first electrode formation step for forming a plurality of first electrodes on a surface of a first glass substrate, a step for applying a dielectric material on the surface of the first glass substrate on which the plurality of first electrodes have been formed and baking the result, a second electrode formation step for forming a plurality of second electrodes on a surface of a second glass substrate, a step for applying a white dielectric material on the surface of the second glass substrate on which the plurality of second electrodes have been formed and baking the result, and a glass substrate alignment step for aligning the first and the second glass substrates so as to face each other, wherein at least one of the first electrode formation step and the second electrode formation step comprises the following substeps:

a base layer formation substep for forming a base layer containing one or more metal oxides selected out of copper oxide, praseodymium oxide, cobalt oxide, nickel oxide, iron oxide, aluminum oxide, and zirconium oxide at a region on the surface of the glass substrate where a layer containing Ag will be formed, the base layer having higher precipitation reactivity of Ag than the surface of the glass substrate; and an Ag layer formation substep for forming the layer containing Ag on the base layer by an electroless plating method, wherein the base layer and the layer containing Ag make up the electrode.

11. A plasma display panel comprising a first glass substrate on which a plurality of first electrodes and a dielectric layer which is formed by applying a dielectric material and baking the result are formed, the dielectric layer covering the plurality of first electrodes, a second glass substrate on which a plurality of second electrodes and a white dielectric layer which is formed by applying a white dielectric material and baking the result are formed, the white dielectric layer covering the plurality of second electrodes, the first and the second electrodes facing each other, wherein at least the first electrodes or the second electrodes have a construction in which a layer containing Ag is laminated on a base layer containing one or more metal oxides selected out of copper oxide, praseodymium oxide, cobalt oxide, nickel oxide, iron oxide, aluminum oxide, and zirconium oxide and palladium is deposited at the interface between the base layer and the layer containing Ag.

* * * * *